US008258905B2

(12) United States Patent
Ellwein et al.

(10) Patent No.: US 8,258,905 B2
(45) Date of Patent: Sep. 4, 2012

(54) SOLENOID UNIT AND METHOD FOR PRODUCING SAID SOLENOID UNIT AND A MAGNET HOUSING FOR SUCH A SOLENOID UNIT

(75) Inventors: Christian Ellwein, Schwaebisch Hall (DE); Olaf Beyer, Dresden (DE); Martin Doerr, Ingelfingen (DE)

(73) Assignee: Buerkert Werke GmbH, Ingelfingen (DE)

( * ) Notice: Subject to any disclaimer, the term of this patent is extended or adjusted under 35 U.S.C. 154(b) by 873 days.

(21) Appl. No.: 11/918,311

(22) PCT Filed: Apr. 13, 2006

(86) PCT No.: PCT/EP2006/003447

§ 371 (c)(1),
(2), (4) Date: Dec. 12, 2008

(87) PCT Pub. No.: WO2006/111330

PCT Pub. Date: Oct. 26, 2006

(65) Prior Publication Data

US 2011/0155936 A1 Jun. 30, 2011

(30) Foreign Application Priority Data

Apr. 20, 2005 (DE) ..... 20 2005 006 296 U
Feb. 9, 2006 (DE) ..... 10 2006 006 031

(51) Int. Cl.
*H01F 7/00* (2006.01)

(52) U.S. Cl. ..... 335/278; 335/220; 251/129.15

(58) Field of Classification Search ..... 335/220–229, 335/278; 251/129.15
See application file for complete search history.

(56) References Cited

U.S. PATENT DOCUMENTS

| | | | | |
|---|---|---|---|---|
| 3,262,027 | A | 7/1966 | Zaleske et al. | |
| 4,443,775 | A | 4/1984 | Fujitani et al. | |
| 6,184,766 | B1 | 2/2001 | Kojima et al. | |
| 6,732,998 | B2 * | 5/2004 | Sugawara et al. | 251/129.07 |
| 6,933,827 | B2 * | 8/2005 | Takeuchi et al. | 336/212 |
| 7,102,475 | B2 * | 9/2006 | Nakagawa et al. | 335/234 |

FOREIGN PATENT DOCUMENTS

| | | |
|---|---|---|
| AT | 256 975 | 9/1967 |
| CH | 552 884 | 8/1974 |
| CN | 2206491 Y | 8/1995 |
| CN | 2268337 Y | 11/1997 |
| CN | 2327058 Y | 6/1999 |
| CN | 1099537 | 1/2003 |
| CN | 2534683 | 2/2003 |
| DE | 1 295 590 | 5/1969 |
| DE | 3202704 | 8/1982 |
| DE | 3105652 | 9/1982 |
| DE | 198 60 631 | 7/2000 |
| EP | 1394399 | 3/2004 |
| GB | 1 441 544 | 7/1976 |
| GB | 2 040 585 | 8/1980 |
| JP | 56-008102 | 1/1981 |

(Continued)

*Primary Examiner* — Bernard Rojas
(74) *Attorney, Agent, or Firm* — Stuart J. Friedman

(57) ABSTRACT

A solenoid unit for a solenoid valve, including a magnet coil and a ferromagnetic circuit which surrounds the magnet coil and comprises a stationary magnet housing, a movable magnet armature and, if required, an armature antipole, the magnet housing being assembled of a cover, a shell and a bottom in the form of multiplayer transformer sheet metal parts.

13 Claims, 4 Drawing Sheets

FOREIGN PATENT DOCUMENTS

| | | |
|---|---|---|
| JP | 57-121108 | 7/1982 |
| JP | 62-005610 | 1/1987 |
| JP | 05-099362 | 4/1993 |
| JP | 06-082813 | 11/1994 |
| JP | 11-273945 | 10/1999 |
| JP | 2001-217120 | 8/2001 |
| JP | 2004-523126 | 7/2004 |
| WO | WO 02086918 | 10/2002 |

* cited by examiner

SOLENOID UNIT AND METHOD FOR PRODUCING SAID SOLENOID UNIT AND A MAGNET HOUSING FOR SUCH A SOLENOID UNIT

FIELD OF THE INVENTION

The present invention relates to a solenoid unit for a solenoid valve, comprising a magnet coil and a ferromagnetic circuit which surrounds the magnet coil and includes a stationary magnet housing and a movable magnet armature. The invention further relates to a method of manufacturing such a solenoid unit and to a method of manufacturing a magnet housing for such a solenoid unit.

BACKGROUND OF THE INVENTION

Electromagnetically driven valves have a magnet coil, a magnet armature for opening and closing the valve, and a magnet housing. In the case of simple designs, the magnet housing is made up of a solid sheet metal part bent into a U-shape. These designs are preferably suitable for a direct current control. In the case of an alternating current control, these designs produce heavy eddy current losses. Bearing in mind the permissible heating, a lower amount of effective power and, hence, less magnetic force is thus available. In addition, it is known from the generic document DE 198 60 631 A1, for example, to produce the magnet housing in one piece from a sheet metal strip which is first punched out and subsequently rolled or bent. There are, however, only limited possibilities of shaping here.

Other alternating current operated solenoid valves are provided with magnet housings made of sintered ferrite material to avoid eddy currents. While these housings are also suitable for direct voltage operation, two valve configurations are fabricated for reasons of cost-saving. In contrast to an alternating current operated valve, no expensive special material such as sintered ferrite is used for the magnet housing of a direct current operated valve, but reasonably priced sheet steel.

SUMMARY OF THE INVENTION

The invention provides a solenoid unit for a solenoid valve, in which the magnet housing is assembled of a cover, a shell and a bottom in the form of multilayer transformer sheet metal parts. One advantage resides in the favorable shape of the magnet housing, because it encloses the magnet coil. Furthermore, thin sheet metal layers can be shaped for a precise fit without great effort, and the electrical resistance at the layer boundaries is already sufficient to reduce eddy current effects to an acceptable degree. Accordingly, it is no longer necessary to manufacture two valve types, for direct current and for alternating current, for cost reasons.

Transformer sheets are especially suitable because, in addition to the appropriate magnetic properties, they have a low thickness of a few tenths of a millimeter. Moreover, transformer sheets are mass-produced on an industrial scale and, hence, are available for use at low cost. In addition, they are also available with an electrically insulating coating, which is of advantage for an even greater reduction of the eddy currents.

In one embodiment, the transformer sheet metal parts are punched and, if required, bent. Since the sheet metal parts used are of a low thickness, these machining steps can be carried out simply and at low cost.

The transformer sheet metal parts have a plurality of layers, it being possible that these layers are connected to each other. This increases the stability of the transformer sheet metal parts and reduces the gap width between the individual layers. Suitable connecting methods include packing of laminations, gluing or riveting, for example.

The bottom and/or the cover may have a central opening. This allows a simple assembly of the solenoid unit, by simply axially inserting the armature, the armature antipole and/or a core guide tube.

In this embodiment, a radial slot is preferably provided in the cover and/or in the bottom, the slot being continuous from the central opening up to the outer periphery. This slot reduces an occurrence of eddy currents in the peripheral direction of the cover and the bottom.

In the assembled condition, the bottom and/or the cover may be caulked to the shell. This is a particularly reasonably priced and reliable type of attachment. Prior to connecting the sheet metal parts, the magnet coil may be introduced into the shell without problems, so that by the caulking process a preassembled unit consisting of the bottom, the cover, the shell and the magnet coil is provided in a very simple manner.

In a further embodiment, the shell of the magnet housing has at least one aperture, and the magnet coil is potted or is coated or encased by injection-molding. A liquid plastic mass is introduced through this aperture into the magnet housing, so that the magnet coil is embedded in plastic material. After the curing of the plastic mass, any gaps or cavities are closed off, and the sheet metal parts of the magnet housing and also the magnet coil are fixed in place such that any rattling noises in the operation of the valve can no longer occur.

The shell may have a thickness that is lower than that of the bottom, and the bottom may have a thickness that is greater than that of the cover. This compensates for increased magnetic reluctances, which appear primarily at the bottom due to the non-magnetic core guide tube and the air gap to the movable magnet armature, by greater sheet metal part thicknesses. Owing to the multilayer structure of the sheet metal parts, the sheet metal part thickness can be varied very easily by varying the number of layers. The stacked sheet metal parts of the cover, the shell and the bottom may differ with respect to the thickness and the characteristics of the individual metal sheets, e.g. they may or may not be insulated.

In one embodiment, the cover comprises an inner cover part and an outer cover part, the outer contour of the inner cover part being complementary to the inner contour of the outer cover part, so that the cover parts can be assembled with an interlocking fit. In this context, it is not a single transformer sheet of the cover that is referred to as a cover part, but a sheet stack built up of a plurality of transformer sheets. This structure made up of two cover parts offers the advantage that the inner cover part, which is comparatively more complicated to produce, can be identically constructed and made use of even with covers of different sizes, and the required adaptation is effected by the outer cover part, which is less complicated to produce. Because of the interlocking connection, the cover, which is composed of the inner and outer cover parts, essentially gives the impression of being a one-piece cover (although built up of a plurality of sheet metal layers), so that the magnetic flux in the plane of the cover is not impaired.

Preferably, the outer cover part is formed in the shape of a U. In this way, the protective ground conductor connection of the inner cover part, which is substantially responsible for the increased manufacturing expense of the inner cover part, is well accessible, whatever the size of the cover.

Furthermore, the cover may have a covering part which covers the cover parts in the assembled condition. In the case of larger covers, by means of this covering part, firstly the sheet metal part thickness of the stack of sheets is increased and secondly the base area of the cover is not separated across its entire thickness by a joint between the inner and outer cover parts. Both factors contribute to a reduction in the magnetic reluctance.

The invention further comprises a method of manufacturing a magnet housing of a solenoid unit for a solenoid valve, comprising the following steps:

A) punching of metal sheets of a ferromagnetic material;

B) stacking the metal sheets to form sheet stacks which are used for the shell, the bottom or the cover or a cover part of a magnet housing of the solenoid unit;

C) assembling the magnet housing by producing an interlocking connection between the cover and the shell and between the bottom and the shell.

This method results in a simple and reasonably priced manufacture of a magnet housing for a solenoid unit which is suitable both for direct current control and alternating current control.

In some embodiments, the cover is assembled from an inner cover part and an outer cover part before assembling the magnet housing, the outer contour of the inner cover part being complementary to the inner contour of the outer cover part. Preferably, the cover parts are then connected with an interlocking fit and/or with a frictional fit. The interlocking connection, but also a possible frictional engagement perpendicular to the plane of the cover provide for an unimpeded magnetic flux in the cover plane and are simple to produce. The cover parts having the complementary contours are preferably punched; the frictional connection may be obtained by means of a press fit between the cover parts, for example. When the U-shaped cover part is connected to the inner cover part with an interlocking fit, its legs may be slightly pressed apart and deformed, so that, when the connecting process is completed, the legs clamp the inner cover part in place and prevent a relative movement between the cover parts perpendicularly to the cover plane.

Subsequent to assembling the inner and outer cover parts, a covering part may additionally be mounted to the inner and/or to the outer cover part. As the surface area of the cover increases, the thickness of the cover may also be adjusted, i.e. enlarged, very easily by means of such a covering part which, just like the inner and outer cover parts, is composed of transformer sheets. The covering part is caulked to the inner and/or to the outer cover part, for example.

In addition, the invention comprises a method of manufacturing a solenoid unit for a solenoid valve, which includes the following steps:

A) punching of metal sheets of a ferromagnetic material;

B) stacking the metal sheets to form sheet stacks which are used for the shell, the bottom or the cover or a cover part of a magnet housing of the solenoid unit;

C) shaping the shell such that it can at least partially surround a magnet coil;

D) inserting the magnet coil into the shell;

E) assembling the magnet housing by producing an interlocking connection between the cover and the shell and between the bottom and the shell.

In one variant of the method, the assembling of the magnet housing starts already prior to inserting the magnet coil into the shell by already producing an interlocking connection between the bottom and the shell or between the cover and the shell. Accordingly, this partial step is omitted in step E.

By means of this method, the magnet housing and the magnet coil are produced as a preassembled unit right away, with the magnet coil being located protected in the interior of the preassembled unit. After fitting a fixed armature antipole and a core guide tube having a movable magnet armature, the solenoid unit is complete.

Subsequent to assembling the magnet housing, a liquid plastic mass is preferably introduced into the assembled magnet housing through an aperture provided in the magnet housing, for embedding the magnet coil. The aperture is produced e.g. by punching before or after the stacking of the metal sheets. After the plastic mass has been introduced and has cured, the sheet metal parts of the magnet housing and the magnet coil are fixed in place, so that no rattling noises can occur.

BRIEF DESCRIPTION OF THE DRAWINGS

Further features and advantages of the invention will be apparent from the description below of a preferred embodiment with reference to the drawings, in which.

DESCRIPTION OF THE PREFERRED EMBODIMENTS

Figure 1:
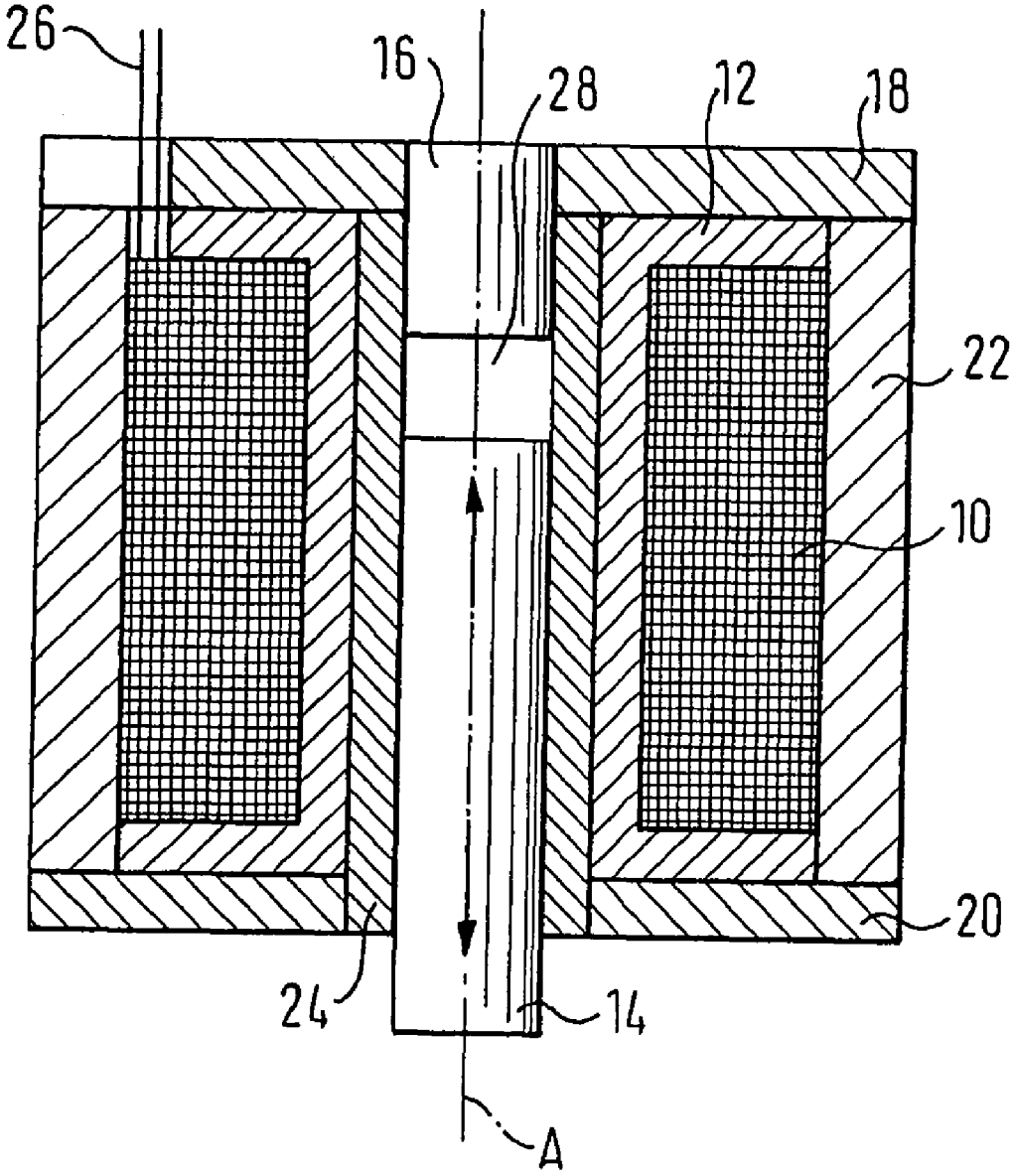
FIG. 1 shows a diagrammatic section through a solenoid unit.

FIG. 1 shows a solenoid unit for actuating a solenoid valve, including a magnet coil 10 determining a coil axis A and having a winding that is received by a bobbin 12. Further illustrated is a ferromagnetic circuit which in FIG. 1 comprises a stationary magnet housing, a movable magnet armature 14 and a stationary armature antipole 16. In the present case, the magnet housing has a cover 18, a bottom 20 and a shell 22. In addition, a non-magnetic core guide tube 24 is provided which extends inside the magnet coil 10 between the bobbin 12 and the magnet armature 14 and armature antipole 16. The power supply to the magnet coil 10 is effected via connections 26 led through axially, which are likewise illustrated diagrammatically.

When the magnet coil 10 is in the de-energized condition, the magnet armature 14 generally is biased by a spring (not shown) such that the solenoid valve is in a desired position (opened or closed). When a current is fed to the magnet coil 10, an axially oriented magnetic field develops inside the magnet coil. The magnet armature 14, the armature antipole 16 and the magnet housing (to be more precise, the cover 18, the bottom 20 and the shell 22) form a ferromagnetic circuit which is decisive for the force exerted on the magnet armature 14. An axial air gap 28 exists between the magnet armature 14 and the armature antipole 16, so that the magnet armature 14 is attracted towards the armature antipole 16. The axial extent of the air gap 28 is equivalent to a driving lift of the solenoid valve.

Figure 2:
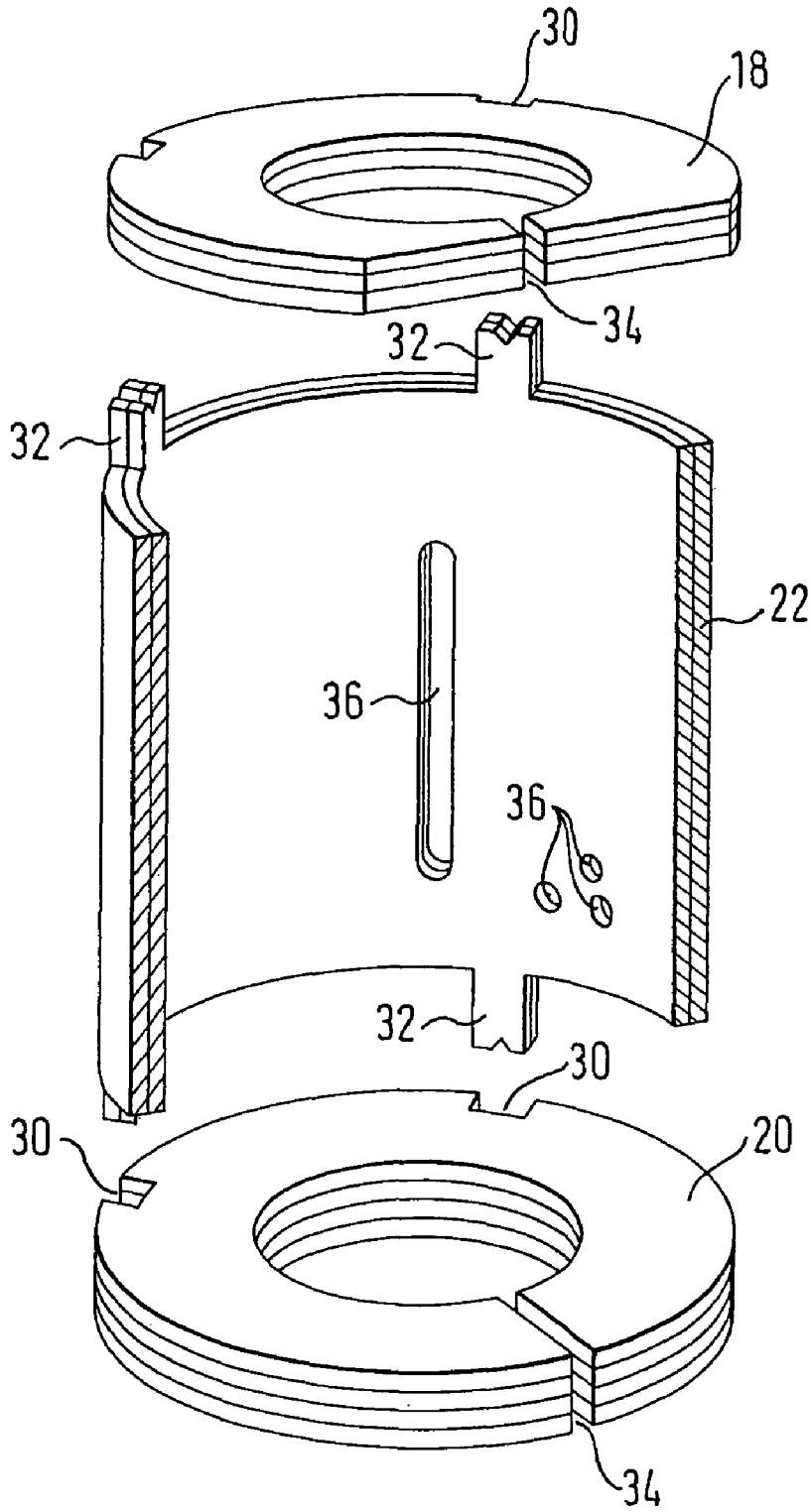
FIG. 2 shows a perspective view of a cover, a bottom and a shell of a solenoid unit according to the invention.

FIG. 2 shows an especially advantageous embodiment of the magnet housing, consisting of the cover 18, the bottom 20 and the shell 22. It can be seen that the sheet metal parts of the magnet housing are built up of multiple layers of transformer sheet metal, the cover 18 and the bottom 20 having a plurality of layers in the axial direction and the shell 22 in the radial direction. The orientation of the sheet stacks, that is, the axial lamination for the cover 18 and the bottom 20 and the radial lamination of the shell 22, is selected to correspond to the course of the magnetic flux lines, with the eddy current paths which run perpendicularly to the magnetic flux lines being however interrupted at the layer boundaries.

In the present embodiment, the individual layers consist of transformer sheet metal which has a thickness of about 1 mm and may be coated with an electrically insulating coating. As a rule, however, a mere lamination of non-insulated transformer sheets is sufficient to largely eliminate the eddy currents as a result of the increased electrical resistance at the layer boundaries. FIG. 2 shows, by way of example, some layers for the respective housing components, which are however only symbolic of a multilayer structure. With layer thicknesses of 1 to 1.2 mm, the individual components preferably comprise 2 to 9 layers. For the purpose of increasing the stability and reducing the gaps, the layers of the components may be connected with each other, e.g. by packing of laminations, gluing or riveting.

The thickness of the sheet metal parts of the magnet housing may be appropriately selected very easily by varying the number of layers. As a rule, the bottom 20, for example, includes more layers than the cover 18 or the shell 22, in order to at least partly compensate for the increased magnetic reluctance in the region of the bottom 20 caused by the non-magnetic core guide tube 24 and the air gap between the core guide tube 24 and the movable magnet armature 14.

Tabs 32 on the shell 22 may be inserted into recesses 30 provided in the cover 18 and the bottom 20. The cover 18 and the bottom 20 are each connected with the shell 22 by assembling the parts and by caulking the tabs 32. The magnet coil 10 may be inserted axially without problems prior to the assembly of the magnet housing and is enclosed inside the magnet housing after caulking of the tabs 32. According to another embodiment, the cover 18 and/or the bottom 20 are welded or screwed to the shell 22.

FIG. 2 shows that the shell 22 is provided with a plurality of apertures 36 through which a liquid plastic mass is introduced after insertion of the magnet coil 10 and assembly of the magnet housing, in order to embed the magnet coil 10 and fix it in place. Commonly used methods of embedding the magnet coil 10 include encasing or coating by injection-molding, or potting. The apertures 36 are preferably provided at places where the effect of the ferromagnetic circuit is least impaired. The cover 18 or the bottom 20 may, of course, also have apertures for this purpose.

The cover 18 and the bottom 20 each have a central opening for insertion of the core guide tube 24 with the magnet armature 14 or of the armature antipole 16. Furthermore, the cover 18 and the bottom 20 each have a radial slot 34 which is continuous from the central opening as far as to the outer periphery, the slot reducing formation of eddy currents in the peripheral direction of the cover 18 and the bottom 20.

Depending on the respective production series of the solenoid valve, the individual sheet metal parts of the magnet housing may exhibit special features. For example, in FIG. 2 the substantially circular cover 18 is cut off along a chord so as to make it easier for the connections 26 of the magnet coil 10 to be led through axially. The extent of the shell 22 in the peripheral direction is essentially dependent on the production series of the valve and merely needs to ensure sufficient magnetic flux. Preferably, however, the multilayer shell 22 surrounds at least half of the magnet coil 10 and, in an extreme case, encloses it entirely, but in the latter case at least one axially extending slot should be provided to reduce an occurrence of eddy currents in the peripheral direction.

Figure 3:
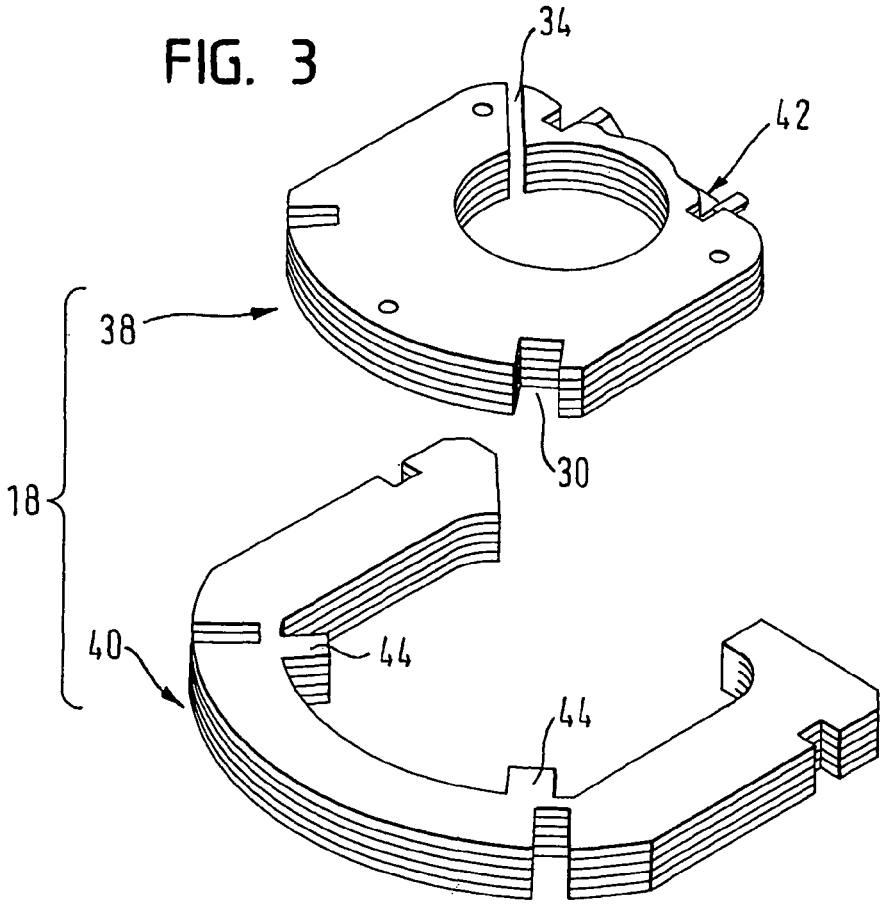
FIG. 3 shows a perspective view of an inner cover part and an outer cover part.
Figure 4:
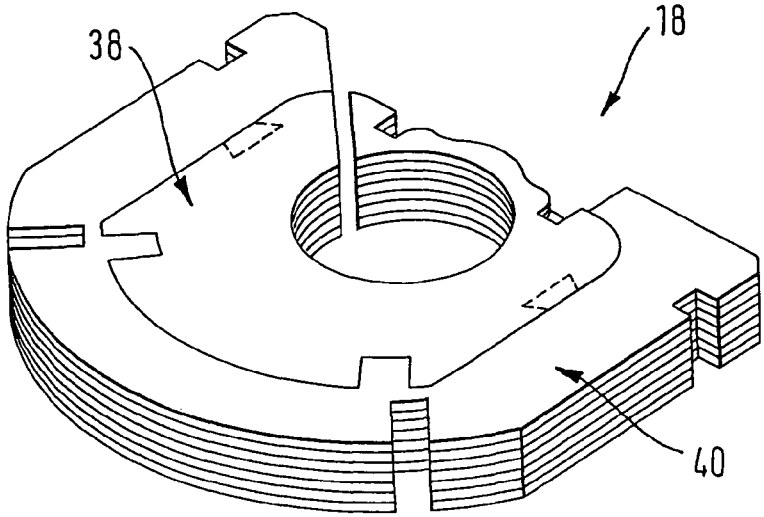
FIG. 4 shows a perspective view of a cover for a solenoid unit according to the invention, the cover being assembled of the inner and outer cover parts according to FIG. 3.

FIGS. 3 and 4 show an inner cover part 38 and an outer, U-shaped cover part 40 and, respectively, a cover 18 assembled of these cover parts 38, 40. For the sake of simplicity, only a cover 18 or cover parts 38, 40 are mentioned below, but, of course, the bottom 20 may also be a multi-piece part, assembled of appropriate bottom parts.

The method of manufacturing the multi-piece cover 18 will now be explained with reference to FIGS. 3 and 4. First, the inner and outer cover parts 38, 40 are produced in a similar manner to the bottom 20 and the shell 22 by punching, stacking and combining ferromagnetic transformer sheets, the outer contour of the inner cover part 38 being complementary to the inner contour of the outer cover part 40. To form a protective ground conductor connection 42 on one side of the inner cover part 38, some of the transformer sheets are provided with recesses and others with projections across the height of the cover 18, resulting in a complex contour the manufacturing of which involves increased tool costs. Because of this higher manufacturing expense, all the embodiments use an identically constructed inner cover part 38 with the protective ground conductor connection 42. In the case of small magnet housings, the inner cover part 38 constitutes the whole cover 18, whereas in the case of larger magnet housings, the U-shaped outer cover part 40, which is simple to produce, is connected with the inner cover part 38 with an interlocking and/or a frictional fit. In that case, the recesses 30 of the inner cover part 38 serve for the interlocking connection with corresponding projections 44 of the outer cover part 40, rather than for a connection with the shell 22 (cf. FIG. 2). For an improved interlocking and/or frictional connection between the cover parts 38, 40, additional cooperating grooves and projections may be provided, which are illustrated in dashed lines in FIG. 4.

Figure 5:
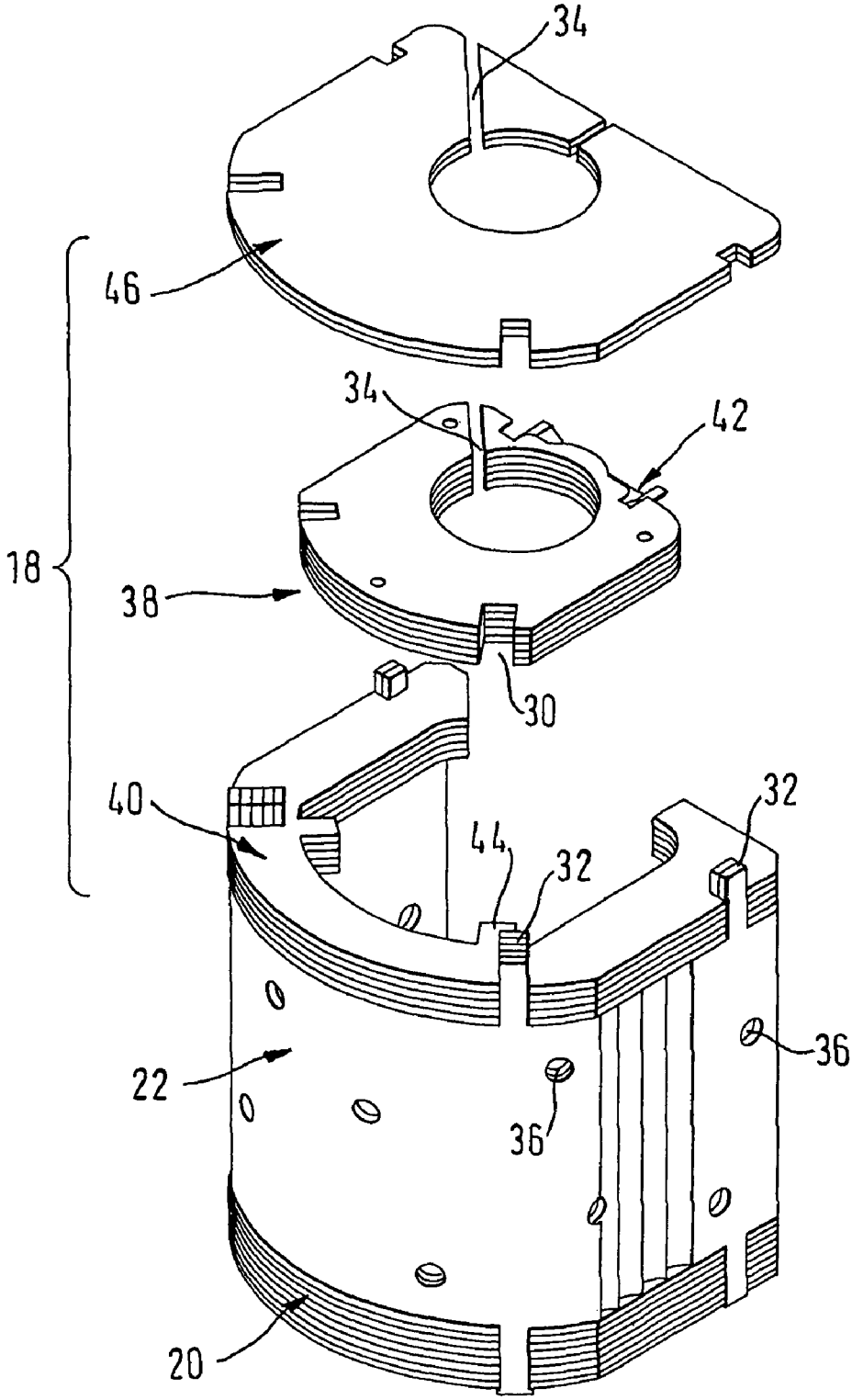
FIG. 5 shows a perspective exploded view of a magnet housing for a solenoid unit according to the invention, including a multipart cover.

FIG. 5 shows an exploded view of a magnet housing having a cover 18 made up of multiple pieces. In order to be able to also adjust the sheet metal part thickness of the cover 18 in the case of larger covers 18, a covering part 46 is provided; this covering part 46 covers the cover parts 38, 40, i.e. the base area of the covering part 46 is the same as the base area of the inner and outer cover parts 38, 40 when in the assembled condition. In this case the shell 22, the outer cover part 40 and the covering part 46 are caulked to each other using the tabs 32 of the shell 22 which, in comparison with those in FIG. 2, are somewhat longer. In addition, the covering part 46 may also be firmly connected with the inner cover part 38. To reduce eddy currents in the peripheral direction of the cover 18, the covering part 46 is likewise provided with a radial slot 34.

The invention claimed is:

1. A solenoid unit for a solenoid valve, comprising a magnet coil and a ferromagnetic circuit which surrounds the magnet coil and includes a stationary magnet housing and a movable magnet armature, wherein the magnet housing is assembled of a cover, a shell and a bottom in the form of multilayer transformer sheet metal parts, said cover comprising an inner cover part and an outer cover part, the outer contour of the inner cover part being complementary to the inner contour of the outer cover part, so that the cover parts can be assembled with an interlocking fit.

2. The solenoid unit according to claim 1, wherein the transformer sheet metal parts are punched and, if required, bent.

3. The solenoid unit according to claim 1, wherein the transformer sheet metal parts have a plurality of layers, these layers being connected to each other.

4. The solenoid unit according to claim 1, wherein at least one of the cover and the bottom has a central opening.

5. The solenoid unit according to claim 4, wherein at least one of the cover and the bottom has a radial slot that is continuous from the central opening up to the outer periphery.

6. The solenoid unit according to claim 1, wherein, in the assembled condition, at least one of the cover and the bottom is caulked to the shell.

7. The solenoid unit according to claim 1, wherein the shell has at least one aperture and the magnet coil is potted, coated or encased by injection-molding.

8. The solenoid unit according to claim 1, wherein the shell has a thickness that is lower than that of the bottom.

9. The solenoid unit according to claim 8, wherein the bottom has a thickness that is greater than that of the cover.

10. The solenoid unit according to claim 1, wherein the outer cover part is formed in the shape of a U.

11. The solenoid unit according to claim 1, wherein the cover has a covering part which covers the cover parts in the assembled condition.

12. A method of manufacturing a magnet housing of a solenoid unit for a solenoid valve, comprising the following steps:

punching metal sheets of a ferromagnetic material;

stacking the metal sheets to form sheet stacks which are used for one of the shell, the bottom, the cover and a cover part of a magnet housing of the solenoid unit;

assembling said cover from an inner cover part and an outer cover part, the outer contour of the inner cover part being complementary to the inner contour of the outer cover part, said cover parts being connected with at least one of an interlocking fit and a frictional fit;

assembling the magnet housing by producing an interlocking connection between the cover and the shell and between the bottom and the shell.

13. The method according to claim 12, wherein subsequent to assembling the inner and outer cover parts, a covering part is mounted to at least one of the inner and the outer cover part.

* * * * *